United States Patent [19]

Lazcano-Navarro et al.

[11] Patent Number: 4,693,274

[45] Date of Patent: Sep. 15, 1987

[54] DEVICE FOR THE SELECTIVE INJECTION OF AN OXIDIZING GAS OR A CARRIER GAS WITH OR WITHOUT CARBONACEOUS MATERIAL TO A LIQUID METAL BATH

[75] Inventors: Arturo Lazcano-Navarro; Miguel A. Alcantara; Jose E. Hernandez-Ruiz, all of Saltillo, Mexico

[73] Assignee: Instituto Mexicano De Investigaciones Siderurgicas, Saltillo, Mexico

[21] Appl. No.: 863,001

[22] Filed: May 14, 1986

Related U.S. Application Data

[63] Continuation-in-part of Ser. No. 642,102, Aug. 20, 1984, abandoned.

[30] Foreign Application Priority Data

May 9, 1984 [MX] Mexico ..... 201284

[51] Int. Cl.[4] ..... F16K 11/00

[52] U.S. Cl. ..... 137/625.4; 137/607; 266/266

[58] Field of Search ..... 137/625.4, 625.68, 112, 137/113, 607; 266/266, 267, 265, 268

[56] References Cited

U.S. PATENT DOCUMENTS

| | | | |
|---|---|---|---|
| 910,163 | 1/1909 | Benninghoff | 137/625.68 |
| 1,575,771 | 3/1926 | King | 137/112 |
| 2,375,914 | 5/1945 | Gordineer | 137/113 |
| 2,721,573 | 10/1955 | Doll | 137/113 |
| 4,407,490 | 10/1983 | Brotzmann | 266/266 |
| 4,552,334 | 11/1985 | Tomiyama | 137/625.11 X |

*Primary Examiner*—Alan Cohan

*Attorney, Agent, or Firm*—Laurence Brown & Associates

[57] ABSTRACT

This invention relates to a device used in the selection between two fluids that are to be injected into a liquid metal contained in a metallurgical converter: an oxidizing gas and another gas conveying powdered carbonaceous material; both fluids arrive through different conduits to a selecting valve located at the bottom of a metallurgical converter just before a single conduit tuyere for leading one of the fluids to the liquid metal by means of the selective mechanism in such valve. The valve design and operation avoids the possibility of mixing the oxidizing gas with the carbonaceous powder in any part of their path up to the metal bath by providing separate passages for each fluid and one inert gas purge passageway between said passages, and further including a safety mechanism which provides control means for the fluid to be correctly injected by avoiding the transport of the oxidizing gas or the carbonaceous material if the corresponding movable passage within the valve body is not correctly and precisely positioned.

4 Claims, 10 Drawing Figures

DEVICE FOR THE SELECTIVE INJECTION OF AN OXIDIZING GAS OR A CARRIER GAS WITH OR WITHOUT CARBONACEOUS MATERIAL TO A LIQUID METAL BATH

This application is a continuation-in-part of application Ser. No. 642,102, filed Aug. 20, 1984 now abandoned.

BACKGROUND OF THE INVENTION

Some processes used in the bulk production of steel in oxygen converters with a basic lining or for the treatment of iron, carry out the injection of oxygen and other gases and additions of solid fluxes in the form of powder through tuyeres located at the bottom of said converter.

This way of injection in the processes of steel production has acquired an increased importance due to its metallurgical and final product quality advantages. Within all the variants for the processing of liquid iron is the injection of powdered carbonaceous materials pneumatically conveyed into the liquid bath through the converter bottom tuyeres. The carbon thus injected goes into solution in the liquid metal, and reacts with the oxygen in the bath. The oxygen is injected through the converter bottom tuyeres or through a top lance. The reaction between carbon and oxygen produces CO and liberates heat and thus, a net energy input to the metal bath is carried out by said powdered carbonaceous material injection, favoring the process thermal balance.

In order to be able to introduce the powdered carbonaceous material or alternatively an oxidizing gas into the liquid metal, a device for selecting one of said fluids located before the converter bottom tuyeres must be used. This is because it is convenient that through the tuyere or tuyeres through which the carbonaceous material is injected, oxygen can also be injected when the carbonaceous material is not needed, i.e., that oxygen can be injected during the no-injection period of carbonaceous material and vice versa through the same tuyere that leads one of the fluids to the liquid metal bath.

The introduction of oxygen or alternatively carbonaceous material through the same conduit, for example, the mentioned tuyere for injection into liquid iron, implies the risk of explosions if the powdered carbonaceous material and oxygen come into contact under certain conditions likely to occur in some cases. This sets up the necessity of a highly safe mechanism able to lead carbonaceous material or alternatively oxygen into the same conduit.

It may be thought that the injection of the carbonaceous material and oxygen be carried out through independent conditions, i.e., certain tuyeres assigned to one fluid and other tuyeres to the other fluid. Unfortunately this arrangement has the inherent disadvantage that during the no injection periods of the carbonaceous material, the duct or tuyere would have to introduce an inert gas whose function would be to avoid the clogging of the tuyere tip by the penetration of the liquid metal, with the consequent thermal ballast and waste of an expensive gas. This is the reason behind the use of a mechanism which allows the use of the same conduit to transport oxygen and the carbonaceous material alternatively.

In the previous art concerning the alternative injection of powder, particularly carbonaceous powder material and an oxidizing gas, U.S. Pat. No. 4,552,334 discloses a device or valve for changing over of fluids and for selecting one to be injected in the converter. Such device has some inconveniences related to design and operation. For instance, one of the main problems related to the design of pneumatic transport systems is the wear of certain components along the transport line, and the worst is the frontal hitting of the solids against the metal in a 90° elbow when a change of flow direction is required; in these cases the wear of a common elbow might be critical. The case of the device disclosed in said patent is very similar. In FIG. 1 a drawing of this valve device is presented in such position and mode of operation that a stream of solids/gas mixture flows through passageway (a) and in changing the direction, said solids hit the deflecting side (b) of such passageway (a) inside the ball valve, resulting in wear of such side and becoming critical when some abrasive material is injected, as for instance carbonaceous material.

Another inconvenience in said patent design is the possible entrapment of powder in the purge conduit (c). For instance, when powder is transported for injection through passage-way (a), it might be entrapped inside conduit (c) and when the change-over takes place to inject the alternative fluid through conduit (d) by rotation of ball (e), the entrapped solids in conduit (c) in some particular cases might not flow out, because when ball (e) rotates, the pressure difference along conduit (c) may not be enough, i.e., in rotation, entry port (f) and exit (g) of conduit (c) both receive certain pressure from the same source of purging gas, entry port (h); although entry port (f) has a bigger pressure, a critical case is when the entrapped solids are sticked or well agglomerated and the rapid rotation during the change-over gives no time for conduit (c) to be flushed. This situation results in a non desirable contact between solid fines, for instance carbonaceous material, and the alternative oxidizing gas.

Prior to the above mentioned art, U.S. Pat. No. 4,407,490 discloses a mechanism for similar application. In this case both inconveniences pointed out for the above described device are also evident: the stream of solid/gas mixture also hits a diverting wall, i.e., a solid disc seal in going through the valve when operated in the solid injection mode; also a possibility exists of mixing the carbonaceous material flow with the alternated flow during the switching operation from one fluid to another due to the fact that a common space does exist where the two fluids might be mixed.

In the two mentioned patents there is not shown a mechanism or direct way of indication of the precise position of the valve movable component so as to enable the control system to allow the flow of the desired fluid only when its single corresponding passage-way is correctly and precisely positioned for the flow of such fluid into the injection tuyere.

In the present invention a valve mechanism is presented for selecting one fluid from two arriving fluids separated by such mechanism for the continuous injection of gas or solid/gas mixture into a melt contained in a metallurgical converter, without the possibility of mixing the two fluids inside such valve by providing separated and independent paths for each fluid and comprising a completely straight path along the solid/gas mixture passage-way inside the valve and thus avoiding any wear effect by the stream of solids in passing through the valve components for injection.

SUMMARY OF THE INVENTION

It is then a primary object of this invention to provide by means of an adequate device the possibility of controlled introduction of oxygen or alternatively powdered carbonaceous materials or alternative gas to a tuyere and then into the metal contained in a converter vessel for such liquid metal treatment. There may be more than one tuyere of this type, but each one corresponding said device will be able to transport oxygen or carbonaceous material alternatively and in a controlled fashion as described above.

Said device assures that the oxygen and carbonaceous material will not come into contact before they enter the liquid bath. Taking into account that the outlet port and tuyere are purged with an inert gas before and after the injection of the carbonaceous material, the elimination of any amount of said carbonaceous material in the common outlet passage and tuyere is assured. Additionally, in the present invention the passage of solids through the valve is designed to avoid any entrapment of solids in any fissures or change of direction or entrapment in the zone of travel through the valve mechanism by providing a completely straight path with a smooth circular cross section; this configuration results in a low flowing particle/valve passage way's wall interaction.

The position of the valve stem for selecting the fluid to be injected in the liquid metal is controlled by an external pneumatic piston, and a pneumatic signal from the valve body indicates the precise position of the stem and only with this signal being present, the flow of the desired fluid for injection is allowed.

DESCRIPTION OF THE INVENTION

Figure 1:
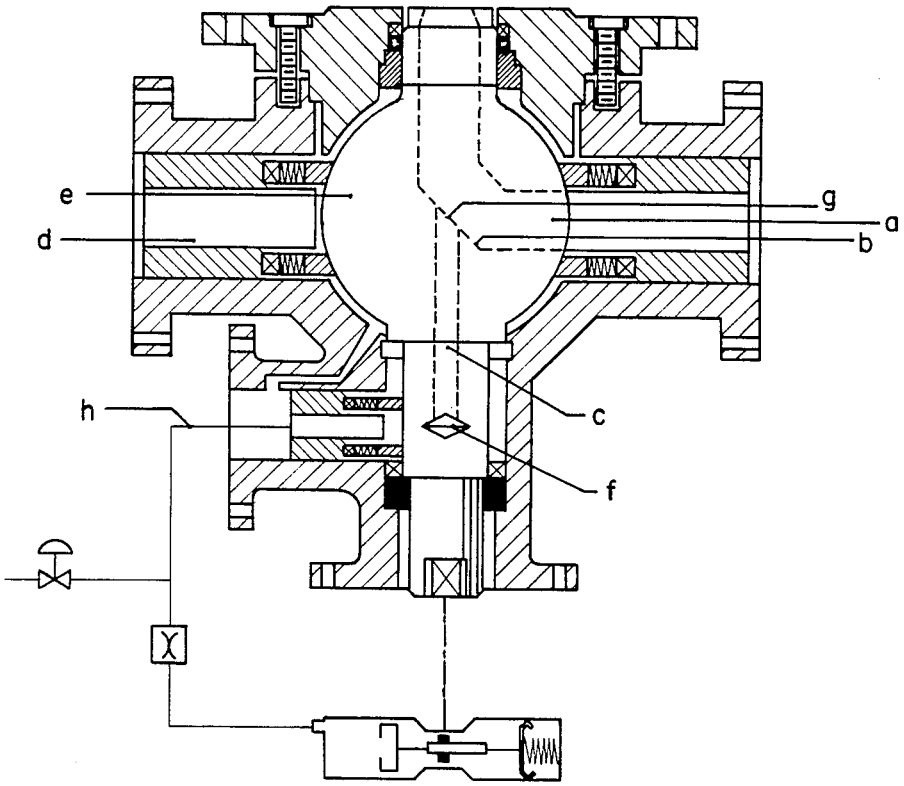
FIG. 1 shows a drawing of the prior art disclosed in U.S. Pat. No. 4,552,334, positioned for the powder injection mode.

The valve consists of a casing (1) with three main inlet ports and a single outlet port to lead the oxidizing gas or the carrier gas into the line 22 and then to the injection tuyere. Inlet port (2) corresponds to the oxidizing gas access; inlet port (3) corresponds to the entry of the carrier gas with or without solid fines in suspension; inlet port (4) maintains a constant pressure of inert gas and is connected to different conduits also to keep them at a high pressure or to purge and maintain flow and pressure in outlet port 5 during the stem switching-over period. The single outlet port (5) lead the selected fluid to the injection tuyere.

Figure 2:
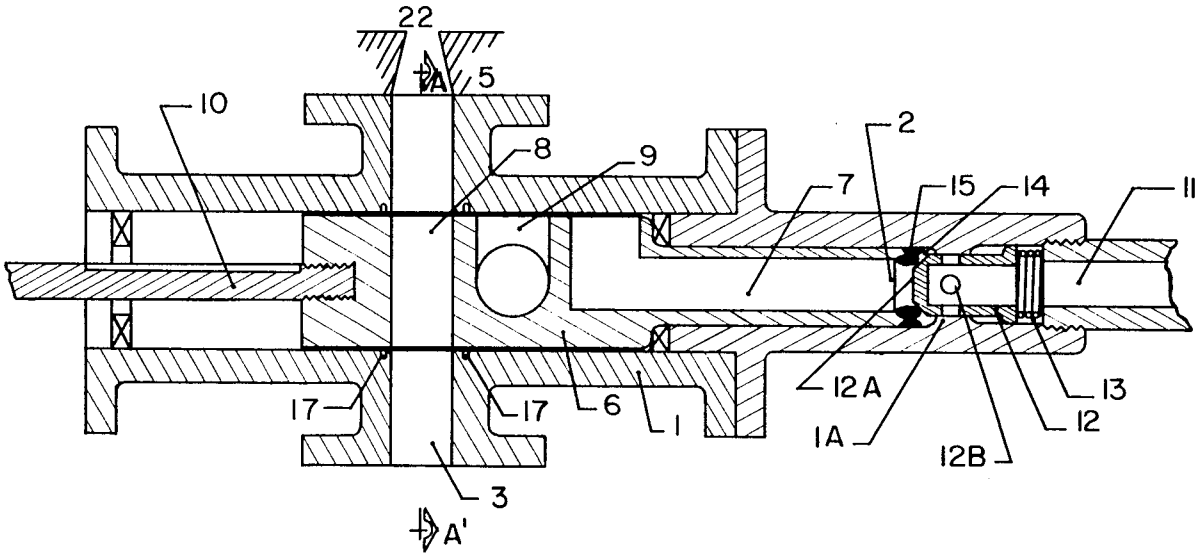
FIG. 2 is a side elevational cross-sectional view of the valve or mechanism according to the present invention to select between the oxidizing gas and the pneumatically conveyed solids with the stem position in the solids injection mode, showing in cross-section three main ports: one inlet port for an oxidizing gas one inlet port for solid/gas mixture and a common outlet port.
Figure 3:
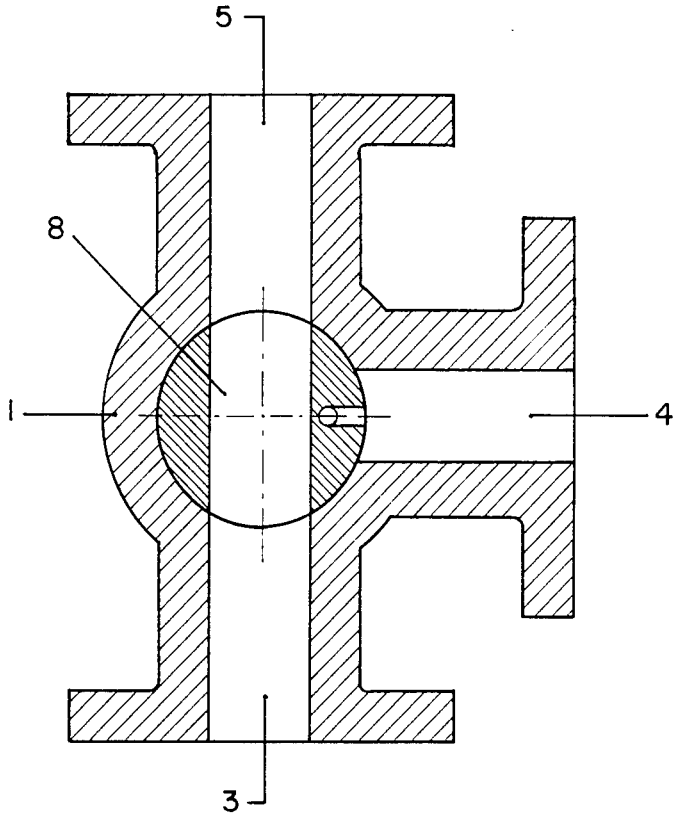
FIG. 3 shows a cross-section of the powder flow path in position of powder injection.
Figure 4:
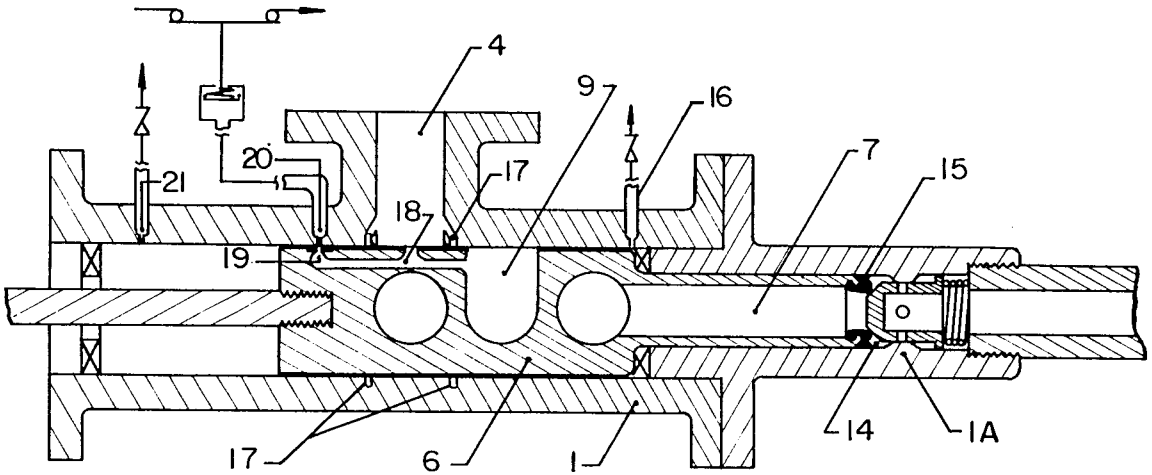
FIG. 4 shows the valve rotated 90° with respect to the position shown FIG. 2 with the stem in the powder injection mode and presenting in the valve case one inlet port for the oxidizing gas, one inlet port for the inert gas purge and pressure switch signal, and three small ports for pneumatic position indication and gas release.
Figure 5:
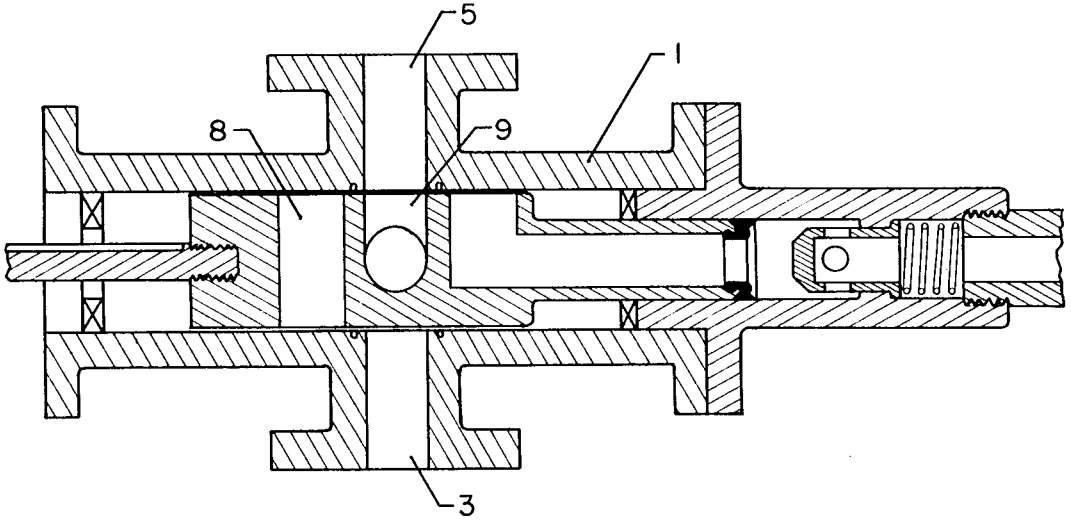
FIG. 5 shows the same cross-section as FIG. 4, with the stem in an intermediate position during the change-over period.
Figure 6:
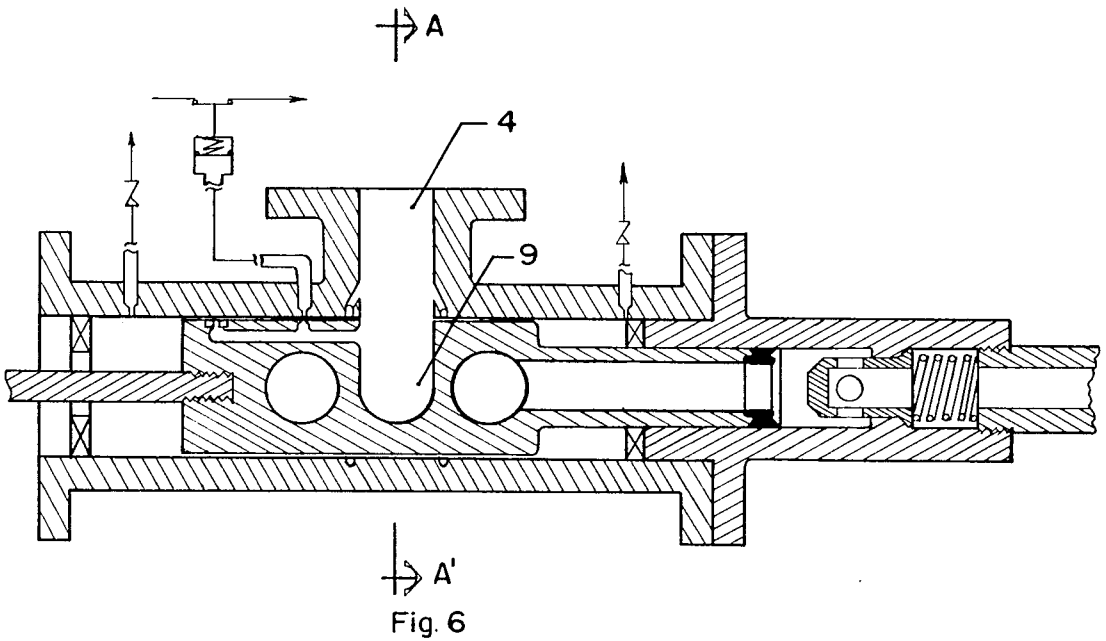
FIG. 6 shows an elevational cross-section view of the valve with the inert gas purging passageway in an intermediate position of injection during the change-over period.
Figure 6A:
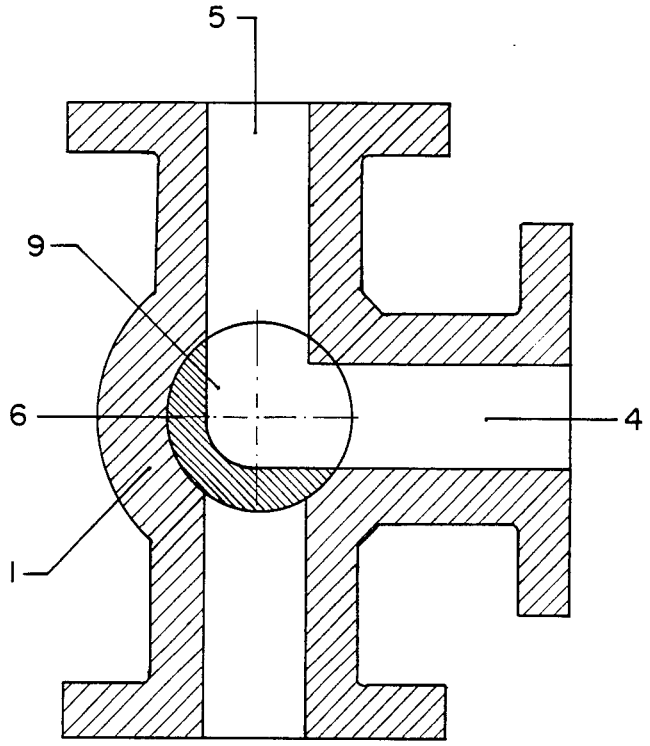
FIG. 6A shows a A—A cut from FIG. 6.
Figure 7:
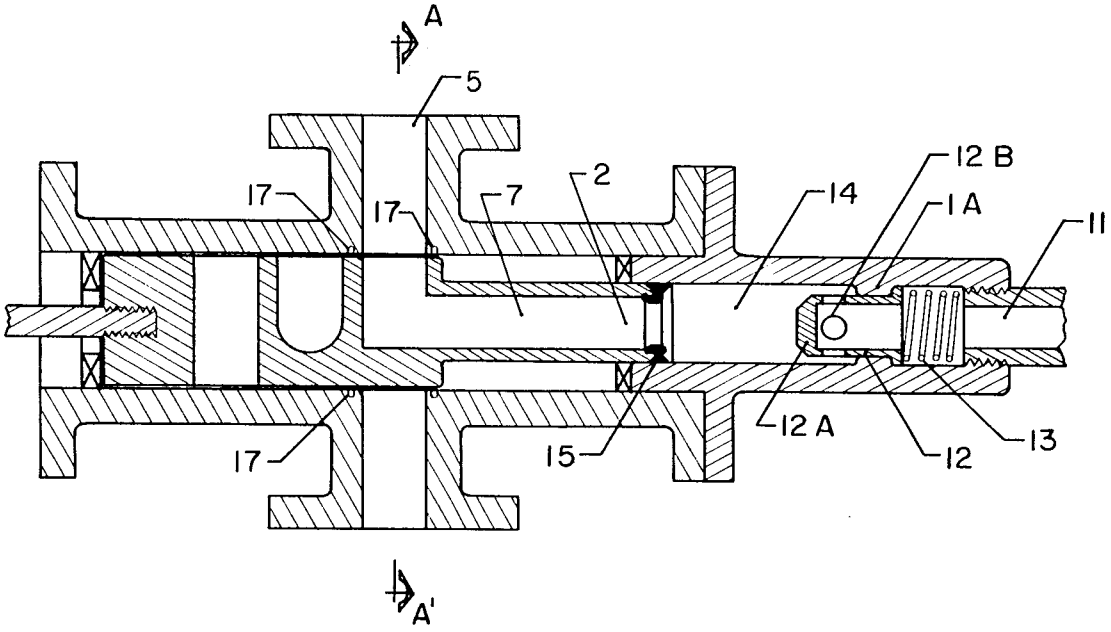
FIG. 7 shows an elevational cross-section as in FIG. 2, but the stem position is in the oxidizing gas injection mode.

The casing (1) as shown in FIG. 2 contains a stem (6) with three passage-ways or conduits in such stem (6); a conduit (7) to lead the oxidizing gas; a conduit (8) to lead the carrier gas with or without powder and a conduit (9) to purge with inert gas the outlet (5) and line (22) will depend on the position of stem (6); for instance FIG. 2 and FIG. 4 present the stem in the position for the powder injection mode as the inlet port (3) connects with conduit (8) and then with the outlet port (5), and FIG. 3 shows this valve in the solids flow path. If the stem (6) is moved by an external pneumatic piston through shaft (10) to select the alternative fluid for injection, as in FIG. 7, and therefore the system is in the mode of oxidizing gas injection, said oxidizing gas enters the valve case through case port (11), then goes through a multi-ports nozzle (12), then to inner case space (14) to flow through entry port (2), and finally conduit (7) which leads the gas to outlet port (5). FIG. 7 shows conduit (7) connected to outlet port (5) for oxygen injection. In this oxygen mode of injection, when for instance oxygen flows through inlet port (2) to passage-way (7), a sealing device (15) is provided to avoid any leakage from inner case space (14), and sealing device (15) is more effective the higher the pressure is in space (14), due to the cup type seal configuration.

Additionally, relieve outlet (16) (see FIG. 4) serves for purging any gas in the space (14) between case and stem to prevent such gas from migrating to the passage-ways (8) and (9) region. Also in the powder flow position, and for non oxidizing gas injection, passage-way (7) is isolated from the oxygen line source (11) by the sealing device (15) and sealing segment (12A) of nozzle (12), which is movable along the case axis to provide an earlier isolation of conduit (7) when shifting from the oxygen injection mode to the powder injection mode, and to improve sealing (12A/15) the movable multinozzle (12) is actuated by spring (13) so that in the oxygen injection mode the multinozzle opens to space (14) as shown in FIG. 7; in changing-over, seal (15) reaches nozzle tip (12A) and nozzles 12B become blocked by the case inner segment 1A. This mechanism for separating the oxygen line from passage-way (7) apart from being a safety means also helps in avoiding a possible disturbance in the stem position by pressure changes from the oxygen line (7), and therefore stem movements are controlled only by the external piston and shaft (10).

Inlet port (4) provides a constant pressure of inert gas for several purposes related to the safety mechanism of the valve. The high pressure inert gas in port (4) connects to channels or furrows (17) formed in the inner surface of case 1, acting as pneumatic seal means adjacent to the corresponding passage-way in the position of injection.

In position for powder injection, as in FIG. 4, inlet port (4) is also connected to conduit, which is communicated through port 19 on one side to port (20), and on the other to passage-way (9). Port (20) is connected to a pressure switch in the control system; when such pressure switch is actuated, and only then, the control system will allow the powder injection system to operate in the position shown in FIG. 2. This safety mechanism is important because during the flow of solids to line (22), the inlet port (3), passage-way (8) and outlet port (5) must be aligned, otherwise outlet port (5) and stem (6) may be deteriorated by contact of the solids, and solid lines entrapment is likely to occur. This safety mechanism requires the alignment of conduits (3), (8) and (5).

Figure 7A:
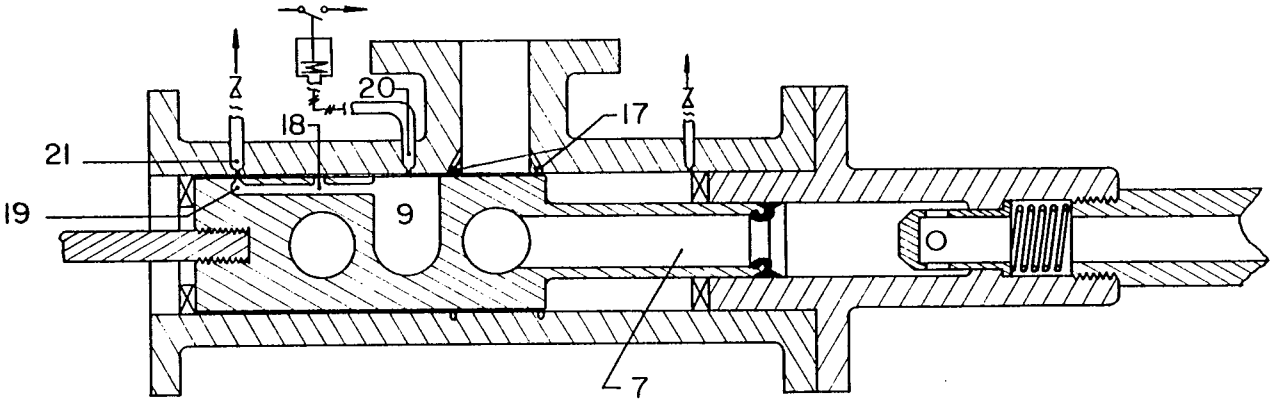
FIG. 7A shows the valve rotated 90° respect to the position in FIG. 7.
Figure 7B:
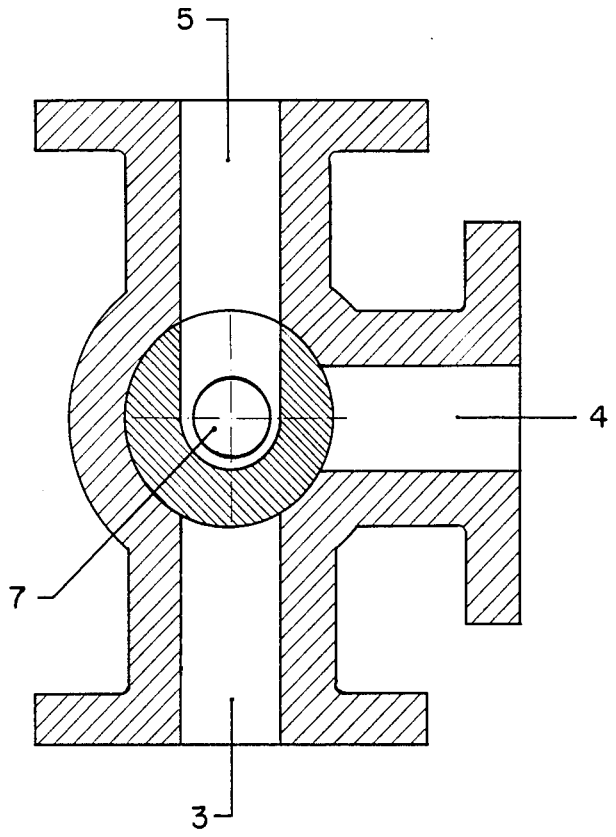
FIG. 7B shows a cross-section of A—A cut of FIG. 7 of the outlet of oxygen path within the valve stem in position of oxygen injection.

When the stem moves to the other extreme position, as shown in FIG. 7 and FIG. 7A, port (20) and its corresponding pressure switch line are connected by the connecting tip of port (20) with passage-way (9), then to conduit (18) and port (19), and finally, to outlet port (21) for releasing the pressure of the pressure switch system. This in turn results in the control system allowing operation of the oxygen flow for injection.

With regard to reliabiity of operation, the concept of design and safety mechanisms together with proper details of manufacture provide a highly reliable device; for instance, in changing from one mode of injection to the alternative one, the gas flow through the injection tuyere is maintined nearly constant by keeping an adequate pressure in outlet port (5). FIGS. (5), (6) and (6A) show cross sections of passage-way (9) in the position of injection at a given time during the changing-over period from the oxygen injection to the powder injection mode; at this time the flow and pressure in the injection tuyere is provided by the gas from port (4). During the completing of the stem shifting period, conduit (5) receives gas from two sources: one from passage-way (9) in its cutting off stage and one from conduit (8) in its opening stage. As conduit (9) slides within the case (1), conduit (8) increases its aperture; so when decreasing the inert gas supplied by conduit (9), the gas supply from conduit (8) increases in such a way that the pressure in outlet 5 and the injection tuyere is at least maintained constant. Thus, inert gas from conduit (9) source provides a middle step safety means for separating the oxidizing gas side entry from the carbonaceous material side entry.

An advantageous of this powder flow path configuration is that when a stream of solid/gas mixture flows in a straightline, the friction loss, due to the interaction of the particles with the tube walls, is low. Those skilled in the art of fines transport will understand that particles travel at high velocity and might advance several dozens of meters in one second; this is the reason why particles traveling in a straight path hit the tube's walls with very low frequency; in changing the flow direction, most of the particles hit the diverting wall. Therefore wear in straight/path flow is much less severe than wear in a 90° particle flow direction change. The straight path configuration of the passage-way for solids in this invention avoids wear of the valve components by the transported powder.

One further advantage of this invention is that the design is simple and conceived for low cost and ease of manufacture.

What we claim is:

1. A valve for controlling the selective supply of an oxidizing gas or another gas conveying powdered carbonaceous material to a tuyere for injection of one of such fluids into a liquid metal bath contained in a metallurgical converter vessel; said valve alternatively permitting the entrance of one of said fluids and comprising a casing having a common outlet port and provided with an inner movable cylindrical stem with three internal conduits that depending on said stem position serve for the passage of one of an oxidizing gas from an oxidizing gas casing access port to the common outlet port, the passage of an inert gas from a casing inlet port for said inert gas to the common outlet port, and the passage of a carrier gas with or without carbonaceous material from a casing access port for the carrier gas to the common outlet port for injection; said casing having three inlet ports for alternative entrance of an oxidizing gas, an inert gas, and a carrier gas with or without carbonaceous material, and having one common outlet port to lead the selected fluid to a tuyere for injection;

said carrier gas entry port, and said stem carrier gas internal conduit, and said carrier gas casing common outlet port forming a cylindrical straight flow path for the pneumatic transport of fines within the valve;

said casing inlet ports and stem conduits disposed in such a way that the carrier gas entry port is located far from the oxidizing gas inlet port and having an internal stem conduit with inert gas pressure as a means of separation between the carrier gas flow path and the oxidizing gas flow path;

said casing having an inner wall provided with two circumferential slots on each side of the common outlet port so as to provide pneumatic seal means to the injection fluid and avoid migration of oxidizing gas and carrier gas with carbonaceous powder out of the central injecting flow path;

said housing having one small port to provide pressurized inert gas to an external pressure switch when the carrier gas inlet port is precisely located to connect the casing single outlet port through the carrier gas stem conduit and thus the stem is positioned in the mode of carrier gas injection, and also having another port used to purge said pressure switch when the stem is precisely positioned for the oxidizing gas injection mode;

said cylindricl stem provided with a reduced extension portion disposed axially with respect to said stem with an axial internal conduit to connect the oxidizing gas casing inlet port to the casing single outlet port;

said stem including a reduced extension portion provided with seal means and being able to activate a movable sealing mechanism located in the oxidizing gas entry port of the casing so as to completely isolate the oxygen line from the rest of the valve when the stem is in carrier gas injection position.

2. A valve according to claim 1, wherein said valve includes a straight-through passageway for carrier gas and in which during the transport of carrier gas and powder within the valve for injection of the powdered carbonaceous material, such powder/gas mixture follows a completely straight cylindrical flow path so as to accomplish the powder passage through the valve without the risk of having any powder entrapment and having minimum wear of the conduit's wall due to the straight flow path configuration.

3. A valve according to claim 1, including separating means between the carrier gas flow path and the oxidizing gas flow path, said separating means defined by a passage-way in between the two said flow paths, pressurizing means for continuously pressurizing the passage-way wherein in a changing-over injection mode the passage-way provides a purging gas to flush the space in-between the oxidizing gas flow path and the carrier gas flow path;

said separating means further including first isolation means carried by the stem conduit that in a given time separates the injection fluid, by providing two circumferential slots formed in the inner casing surface adjacent to the common outlet port so as to avoid any diffusion of the injection fluid through the gap formed between the casing and the stem;

said separating means further comprising second isolation means for isolating the oxidizing gas source line and the corresponding casing inlet port from the rest of the valve when the stem is in position for carrier gas injection by providing a seal between the stem oxidizing gas conduit and the oxidizing gas inlet to the valve when carrier gas is injected.

4. A valve according to claim 1, including safety means for avoiding the injection of a given fluid if a corresponding stem conduit is not precisely positioned for the passage of such fluid, said safety means including a casing port connected to a pressure limit switch which is actuated by pressurized inert gas when the stem is in the carrier gas injection position and when changing-over to the oxidizing gas injection position, wherein the pressure switch operates to allow the injection of the oxidizing gas so that if the stem is not precisely positioned, the corresponding fluid will not be permitted to flow by the safety means.

* * * * *